United States Patent [19]

Breiding et al.

[11] 4,291,569

[45] Sep. 29, 1981

[54] HYDRAULIC PRESS

[75] Inventors: Hans-Joachin Breiding, Krefeld-Fischeln; Manfred Bachen, Krefeld, both of Fed. Rep. of Germany

[73] Assignee: G. Siempelkamp GmbH & Co., Krefeld, Fed. Rep. of Germany

[21] Appl. No.: 134,267

[22] Filed: Mar. 26, 1980

[30] Foreign Application Priority Data

Mar. 27, 1979 [DE] Fed. Rep. of Germany ..... 2911901

[51] Int. Cl.[3] ..... B21D 5/00

[52] U.S. Cl. ..... 72/403; 72/7; 72/21; 72/453.18

[58] Field of Search ..... 72/403, 7, 21, 453.18, 72/453.01, 402, 389, 386

[56] References Cited

U.S. PATENT DOCUMENTS

| | | | |
|---|---|---|---|
| 2,066,025 | 12/1936 | Zublin | 72/403 |
| 2,342,745 | 2/1944 | Maize | 72/7 |
| 2,734,550 | 2/1956 | Glenn | 72/403 |
| 2,828,531 | 4/1958 | Bath | 72/403 |

*Primary Examiner*—Gene P. Crosby

*Attorney, Agent, or Firm*—Karl F. Ross

[57] ABSTRACT

A hydraulic press assembly for forming a U-profile from a rectangular plate comprises horizontally and vertically reciprocatable press members each having two hydraulic actuating cylinders. The horizontal cylinders are energized by respective variable-displacement pumps provided with servomechanisms operated by an electronic control circuit for selectively varying pumping rates to center a plate prior to a first bending phase in which the pump output ducts are connected to the vertical cylinders. During the first bending phase, synchronization of the action of the vertical cylinders is effectuated via control-circuit adjustment of the pump servomechanisms, while horizontal centering is maintained by means of an additional hydraulic circuit connectable by the control circuit to the horizontal cylinders. During a second bending phase, constituting opposing motion by the horizontal presses to form the already bent plate about a semicylindrically shaped head on the vertical press, horizontal centering is attained by selective control-circuit adjustment of the servomechanisms to incrementally differentiate the pressurizations of the horizontal cylinders.

8 Claims, 2 Drawing Figures

HYDRAULIC PRESS

FIELD OF THE INVENTION

Our present invention relates to a hydraulic press. More particularly, our present invention relates to a hydraulic press for forming U-profiles from sheet metal.

BACKGROUND OF THE INVENTION

A press assembly for bending rectangular metal plates into U-profiles in the production of pipe sections conventionally includes a supporting frame, a vertically reciprocatable press beam, a pair of further press members operative in opposite directions in a horizontal plane, a centering device and a hydraulic drive with at least two actuating cylinders for each horizontal press member and with a synchronizing control. The plates to be bent frequently have a thick cross section and are highly resistant to bending stresses, and yet the U-profiles must be formed with very limited tolerances.

Generally, the synchronizing control comprises mechanical elements such as torsion shafts and racks and pinions which unavoidably have a play leading to undesirably large errors in the formation of the pipe sections. Furthermore, the centering device works independently of the hydraulic cylinders of the horizontal-press drive and consists of a combination of positioning spindles and hydraulic cylinders having their own characteristic error margins which become superimposed on the error due to the synchronizing control. Pipe sections with unacceptable deviations in dimensions must be either scrapped or specially handled. It is also notable that in known bending assemblies the horizontally operating press members are powered by a common pump.

OBJECT OF THE INVENTION

The object of our present invention is to provide an improved press of the above-described type, having greater reliability in the production of U-profiles with narrow tolerances.

SUMMARY OF THE INVENTION

A hydraulic press assembly for forming U-profiles in the production of pipe sections comprises, according to our present invention, a vertically reciprocatable press member and a pair of horizontally reciprocatable press members all mounted on a supporting frame, the vertical press bending a rectangular plate along its length during a first phase of a deformation process and the horizontal presses operating in a common plane for coacting to bend a plate during a second phase of a deformation process. The frame carries an aligner for centering a plate with respect to the presses prior to the first deformation phase, and a hydraulic drive including a plurality of cylinders operatively connected to each of the horizontal presses for actuating the same. An electronic control is operatively linked to the drive for sequencing the actuation of the presses, while synchronizing means on the frame centers a plate with respect to the presses during the first and second bending phases. The synchronizing means includes positions monitor engageable with a plate for detecting the position and orientation thereof, the control circuit being connected to the synchronizing means for selectively adjusting, via the drive, the pressurization of the cylinders in response to signals from the monitors.

According to another feature of our present invention, the drive includes a multiplicity of variable-displacement pumps connected to the respective cylinders for pressurizing the same and the aligner includes an adjuster operatively linked to the control circuit and the pumps for selectively varying the displacement thereof according to signals emitted by the control circuit at least partially in response to the output signals of the monitors, whereby the cylinders are actuated to center a plate prior to the bending thereof.

According to another feature of our present invention, the drive further includes a plurality of hydraulic actuators connected to the vertical press and valves inserted between the pumps and the actuators, the valves being operated by the control circuit to enable the driving of the actuators by the pumps to bend a plate during the first deformation phase. The synchronizing means includes a pressurized fluid source, e.g. a pump, and additional valves linking the same to the cylinders; the control circuit has leads extending to the additional valves for activating the same selectively adjust the pressurization of the cylinders during the first deformation phase. Preferably, the synchronizing means further includes additional monitors engageable with an upper or lower surface of a plate during the bending process, these monitors being linked to the control circuit for signaling thereto the vertical position and orientation, i.e. slant about a horizontal axis, during the first deformation phase, whereby the control circuit may operate the adjuster to incrementally vary the pressurization of at least one actuator during such phase to ensure synchronized loading of the plate by the actuators.

According to still further features of our present invention, the control circuit is designed to initially actuate, during a centering phase, one of the cylinders to extend its plunger a predetermined distance and to actuate, either subsequently or simultaneously but more slowly, the remaining cylinders to have plunger extensions equal to that of the initially operated cylinder. A programmer may be connected to the control circuit for enabling the handling of differently sized plates by the assembly according to our present invention, while the monitors are advantageously secured to the frame in the region of the plane of operation of the cylinders.

BRIEF DESCRIPTION OF THE DRAWING

These and other features of our present invention will now be described in detail, reference being made to the accompanying drawing in which.

SPECIFIC DESCRIPTION

Figure 1:
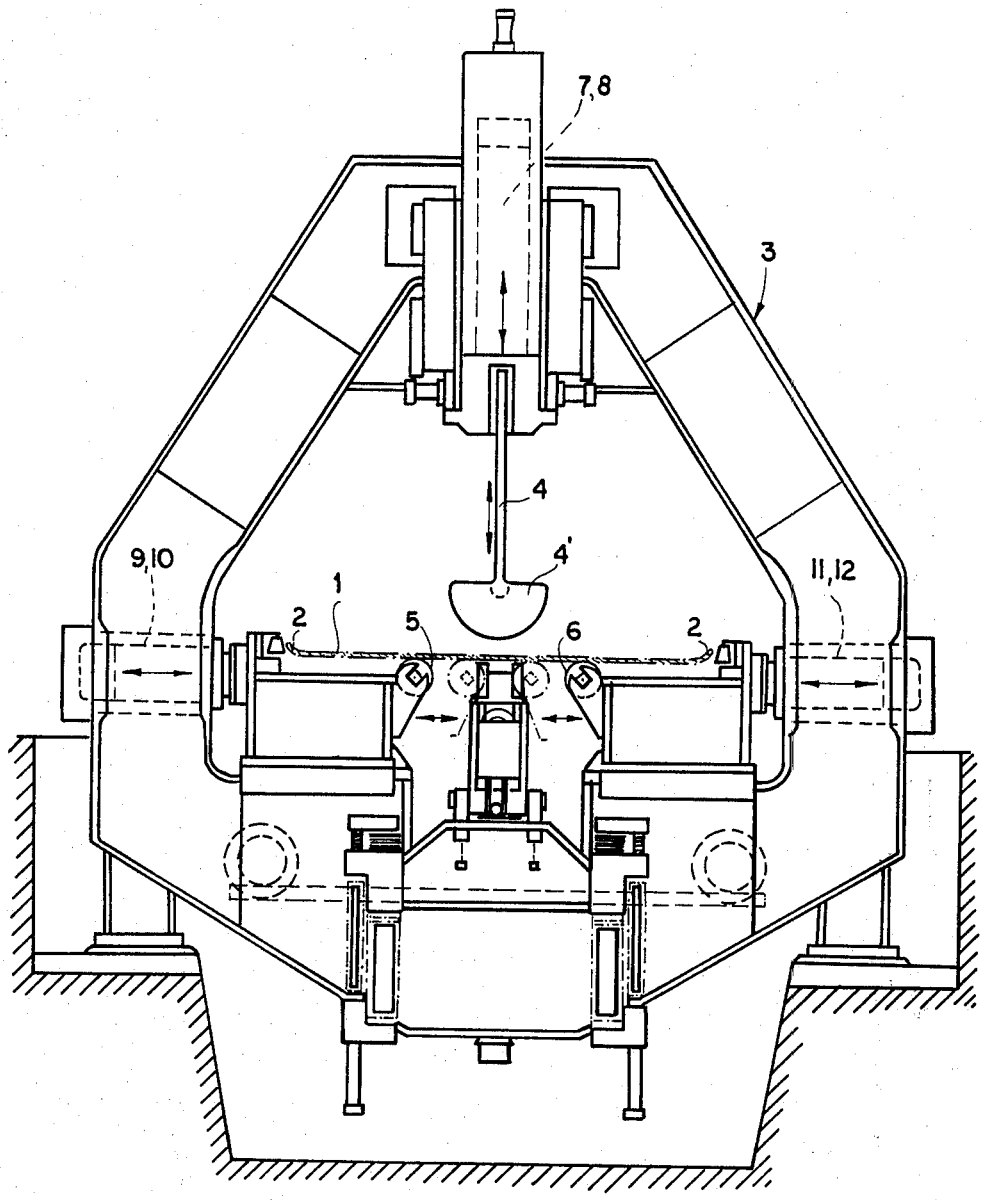
FIG. 1 is a partially schematic elevational view of a press assembly according to our present invention.

As shown in FIG. 1, a press assembly for forming a rectangular plate 1, possibly having upturned longitudinal edges 2, into a U-profile for welding to another profile to form a pipe section comprises a vertically reciprocatable press member 4 having a semi-cylindrically shaped head 4' and a pair of horizontally reciprocatable press members 5, 6 disposed on opposite sides of a plane of motion of vertical press 4. Press member 4 is integral with the plungers of two hydraulic cylinders 7,8 in turn secured to a supporting frame 3 on which press members 5, 6 are slidably mounted. The horizontal presses 5, 6 are connected to the plungers of respective cylinder pairs 9, 10 and 11, 12 also secured to frame 3.

Figure 2:
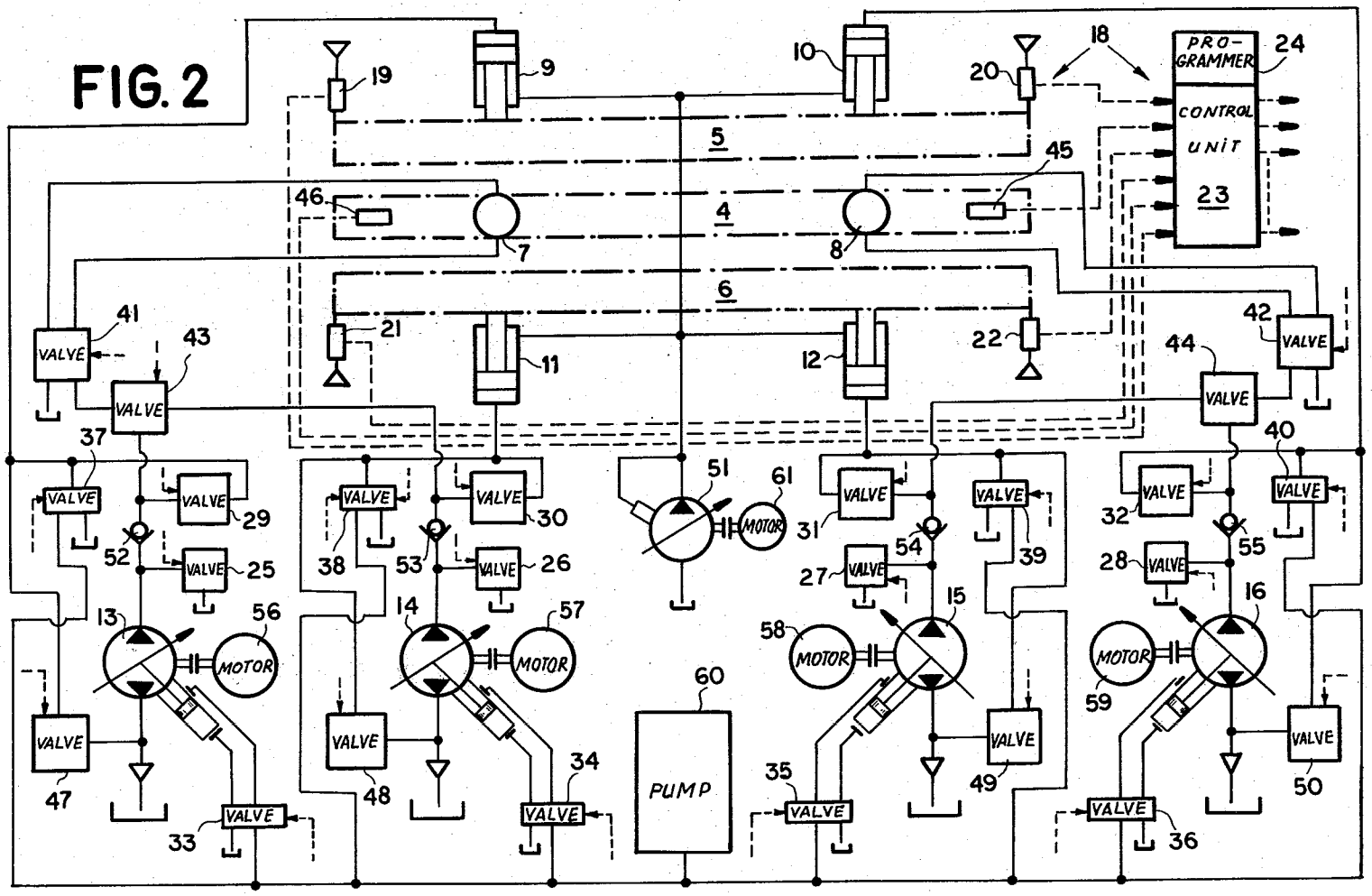
FIG. 2 is a diagram of a hydraulic drive and control for the assembly of FIG. 1.

As shown in FIG. 2, a hydraulic drive for energizing cylinders 9, 11, 12, 10 includes four variable-displacement pumps 13–16 connectable to the cylinders via respective check valves 52–55 and respective control valves 29–32, these pumps being continuously driven by respective motors 56–59. The degrees of displacement of the pumps are determined by a control unit 23 via servomechanisms including electrically energizable valves 33–36 which are supplied with pressurized fluid from a pump 60. Pumps 13–16 are connected at fluid outputs to respective pressure relief valves 25–28, as well as to control valves 29–32.

A system for ensuring alignment of a plate 1 by horizontal cylinders 9–12 during a bending phase implemented by vertical press member 4, 4' includes four valves 37–40 having fluid input lines extending from pump 60 and fluid output lines extending to cylinders 9, 11, 12, 10, respectively. The restoration of the horizontal cylinder assembly to a rest state is effected with the aid of a retraction-pressure generator comprising a single pump 51 and energizing motor 61; a fluid forced into the horizontal cylinders 9, 11, 12, 10 by pumps 13–16 during an initial centering phase and by pump 60 via valves 37–40 during the afore-mentioned bending phase is sucked out of the cylinders by pumps 13–16 via valves 47–50.

As shown in FIG. 2, a synchronization system 18 includes six position monitors 19–22, 45, 46 engageable with a metal plate 1 for detecting the position and orientation thereof during centering and bending operations. Upon the feeding of a rectangular plate 1 to the assembly of FIG. 1 by a conveyor (not shown), control unit 23 activates servovalves 33–36 to increase the displacement of pumps 13–16 from a rest level to a first predetermined alignment level for a master cylinder 9–12 and to a second predetermined alignment level for the other, subordinate cylinders, control valves 29–32 and relief valves 25–28 being simultaneously opened and closed, respectively. Upon the emission by the monitor 19–22 associated with the master cylinder of a signal coding a predetermined plunger extension, i.e. a predetermined position of a corresponding corner of the plate 1, the associated control valve and relief valve are respectively closed and opened. The remaining horizontal cylinders are then controlled by unit 23 via respective pumps 13–16 and servovalves 33–36 thereof to attain plunger extensions equal to that of the master cylinder, the extensions being signaled to the control unit 23 by monitors 19–22. Upon the completion of the centering phase, valves 29–32 are all closed and valves 25–28 opened, while pumps 13–16 are set at the rest displacement levels.

The afore-mentioned bending phase is subsequently initiated with the activation of servovalves 33–36 to increase the displacement of pumps 13–16 to substantially equal relatively high levels. Relief valves 25–28 are then closed, while two pairs of further valves 41, 43 and 42, 44 are opened, under the control of unit 23, to connect the output ducts of pumps 13, 14 and 15, 16 to vertical cylinders 7 and 8. During the consequent bending of plate 1, a symmetrical orientation of the plate is maintained by valves 37–40 in response to energization signals emitted by unit 23 according to the outputs of position monitors 19–22. A synchronization of the vertical cylinders, 7,8 to achieve an even bending by member 4, 4' along the length of plate 1 is effected by control unit 23 which selectively operates servovalves 35, 36 to vary the action of cylinder 8 in response to the output signals of vertical-position monitors 45, 46. Upon the attainment of maximal bending by the vertical cylinders, for example consisting of the arresting of the plate 1 by a stopper lug, valves 41, 43, and 42, 44 are closed to hold vertical press member 4, 4' in a lowermost position, relief valves 25–28 being simultaneously opened. The displacements of pumps 13–16 may be temporarily set at rest levels.

A second bending phase is begun with the setting of pump displacements to substantially equal elevated levels, the opening of control valves 29–32 and the closing of relief valves 25–28, whereby horizontal press members 5,6 are actuated to form an already bent plate around head 4'. Any synchronization errors are immediately detected by monitors 19–22 and compensated for by control unit 23 which operates servovalves 33–36 to selectively adjust the fluid output of pumps 13–16. Upon the completion of this second bending phase, as recognized by unit 23 via monitors 19–22, control valves 29–32 are closed and valves 25–28, 47–50 are opened, whereby pumps 13 cooperate with pressure generator 51, 61 to retract the plungers of the horizontal cylinders 9–12. Upon completed plunger retraction, unit 23 closes valves 47–50 and operates valves 41, 43 and 42, 44 to raise vertical press member 4, 4'. Valves 41–44 are subsequently closed and servovalves 33–36 controlled to restore rest-level pump displacements. A U-profile is now ready for removal from the assembly of FIG. 1 by a conveyor (not shown).

A programmer 24 is advantageously connected to unit 23 for enabling the control of centering and synchronization operations for plates of different dimensions. The control unit and the programmer may collectively comprise a microprocessor.

We claim:

1. A hydraulic press assembly for forming U-shaped profiles in the production of pipe sections, comprising:

a supporting frame;

vertically reciprocatable press means carried by said frame for bending a rectangular plate during a first phase of a deformation process;

first horizontally reciprocatable press means on said frame;

second horizontally reciprocatable press means mounted on said frame and operating in a common plane with said first horizontally reciprocatable press means for coacting therewith in bending a plate during a second phase of a deformation process;

aligning means on said frame for centering a plate with respect to said press means prior to said first phase;

hydraulic drive means on said frame for actuating said press means, said drive means including a plurality of hydraulic cylinders for operating each horizontally reciprocatable press means;

electronic control means operatively connected to said drive means for sequencing the actuation of said press means; and synchronization means on said frame for centering a plate with respect to said press means during said first and second phases, said synchronization means including position monitors engageable with a plate for detecting the position and orientation thereof, said control means being operatively connected to said synchronization means for selectively adjusting, via said drive means, the pressurization of said cylinders in response to signals from said monitors.

2. The assembly defined in claim 1 wherein said drive means includes a multiplicity of variable-displacement pumps connected to respective cylinders for pressurizing same, said aligning means including adjustment means operatively connected to said control means and to said pumps for selectively varying the displacement thereof according to signals emitted by said control means at least partially in response to the output of said monitors, whereby said cylinders are actuated to center a plate prior to bending thereof.

3. The assembly defined in claim 2 wherein said drive means includes hydraulic actuators operatively connected to said vertically reciprocatable press means and valve means inserted between said pumps and said actuators, said control means being operatively linked to said valve means for opening same to enable said pumps to drive said actuators, thereby moving said vertically reciprocatable press means to bend a plate during said first phase.

4. The assembly defined in claim 3 wherein said synchronization means includes a pressurized fluid source and additional valve means linking same and said cylinders, said control means being operatively connected to said additional valve means for activating same to selectively adjust the pressurization of said cylinders during said first phase.

5. The assembly defined in claim 3 or 4 wherein said synchronization means includes additional monitors linked to said control means for signaling thereto the vertical position and orientation of a plate during said first phase, whereby said control means may operate said adjustment means to incrementally vary the pressurization of at least one of said actuators during said first phase to ensure synchronized loading of a plate by said actuators.

6. The assembly defined in claim 1 or 2 wherein said control means is designed to initially actuate, during a centering phase, one of said cylinders to extend its plunger a predetermined distance and then to actuate the remaining cylinders to have plunger extensions equal to that of the initially operated cylinder.

7. The assembly defined in claim 1, 2 or 4 wherein said monitors are secured to said frame in the region of said plane.

8. The assembly defined in claim 1, 2 or 4, further comprising a programmer connected to said control means for enabling the bending of differently sized plates by said assembly.

* * * * *